US008175469B2

(12) United States Patent
Shimizu

(10) Patent No.: US 8,175,469 B2
(45) Date of Patent: May 8, 2012

(54) IMAGE FORMING DEVICE WITH VARIABLE OUT-OF-TONER AND LOW-TONER DISPLAY

(75) Inventor: Takatoku Shimizu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 398 days.

(21) Appl. No.: 12/432,038

(22) Filed: Apr. 29, 2009

(65) Prior Publication Data

US 2009/0297177 A1 Dec. 3, 2009

(30) Foreign Application Priority Data

May 30, 2008 (JP) ..... 2008-142002

(51) Int. Cl.
*G03G 15/00* (2006.01)
*G03G 15/08* (2006.01)

(52) U.S. Cl. ..... 399/24; 399/27; 399/44

(58) Field of Classification Search ..... 399/24, 399/25, 27, 29, 43, 44, 45, 81
See application file for complete search history.

(56) References Cited

U.S. PATENT DOCUMENTS

| | | | | |
|---|---|---|---|---|
| 4,707,748 | A * | 11/1987 | Ohtsuka et al. | 399/25 X |
| 6,510,294 | B1 * | 1/2003 | Hakamada | 399/27 X |
| 6,628,904 | B2 * | 9/2003 | Yamada | 399/27 |
| 6,754,453 | B2 * | 6/2004 | Siegel et al. | 399/24 |
| 7,027,745 | B2 * | 4/2006 | Yoshida et al. | 399/25 |
| 7,068,393 | B2 * | 6/2006 | Sasanuma et al. | 358/1.9 |
| 7,415,214 | B2 * | 8/2008 | Sakita et al. | 399/27 |

FOREIGN PATENT DOCUMENTS

| | | |
|---|---|---|
| JP | A-2002-244512 | 8/2002 |
| JP | A-2004-361752 | 12/2004 |
| JP | 11-038744 A | 2/2005 |

* cited by examiner

*Primary Examiner* — Sandra Brase
(74) *Attorney, Agent, or Firm* — Posz Law Group, PLC

(57) ABSTRACT

An image forming device includes an imaging apparatus configured to form an image according to image data and to maintain information associated with performance of the imaging apparatus, a replaceable member that is mounted in the imaging apparatus and used for forming an image, a consumed amount calculation unit configured to calculate a usage value of the replaceable member, and a notification control unit configured to control a replacement notification. Wherein the notification control unit controls a timing of the replacement notification based on the usage value calculated by the consumed amount calculation unit and the information associated with performance of the imaging apparatus.

20 Claims, 7 Drawing Sheets

| Environment Value | e=1 | e=2 | e=3 | e=4 | e=5 | e=6 | e=7 |
|---|---|---|---|---|---|---|---|
| TONER LOW DISPLAY JUDGMENT VALUE | 70% | 80% | 90% | 90% | 90% | 80% | 70% |
| TONER OUT DISPLAY JUDGMENT VALUE | 80% | 90% | 100% | 100% | 100% | 90% | 80% |

IMAGE FORMING DEVICE WITH VARIABLE OUT-OF-TONER AND LOW-TONER DISPLAY

CROSS REFERENCE TO RELATED APPLICATION

The present application is related to, claims priority from and incorporates by reference Japanese Patent Application No. 2008-142002, filed on May 30, 2008.

TECHNICAL FIELD

The present invention relates to an image forming device using an electrographic process for developing on a recording medium by forming an electrostatic latent image on an image supporter based on image data, wherein a consumable member such as a toner cartridge for containing toner is demountable.

BACKGROUND

In the past, for an image forming device such as a printer, copying machine, facsimile machine, and electrographic color recording device, an electrostatic latent image has been formed through exposure by an exposing source. The surface of a photoconductor drum is uniformly electrically charged by a charging device. The electrostatic latent image is developed by a developing roller. Then, after the toner image is formed on the photoconductor drum by using toner as the developer, the toner image is transferred and fixed onto the recording medium.

A replaceable toner cartridge is mounted in the process cartridge within the image forming device, for dispensing toner. In addition, because the quality of the image cannot be maintained when the remaining toner within the developing device is below a predetermined value, there has been an image forming device (for instance, refer to Japanese laid-open application publication number H11-38744) that can continue printing after informing a user to replace the toner cartridge by displaying a warning on the display unit of the image forming device while the remaining toner detecting mechanism detects that the available toner has been consumed or is at a low level when toner quantity falls below a prescribed level.

However, with such an apparatus, the timing of the toner out or toner low warning on the display unit is set on the assumption that standard images will be printed. As a result of this, when a user of the image forming device prints image data that differs from a standard image in image area ratio or the like, even though the toner out or toner low warning is displayed, there is a risk that the toner level might decrease more rapidly than estimated or that the quality of the developed image might be degraded due to progressing toner degradation.

In view of the above risk, an objective of the present invention is to provide an image forming device that can maintain the quality of the developed image satisfactorily without depending on the image area ratio or the like contained in the image data.

In order to solve the aforementioned problems, an image forming device that relates to the present invention includes an imaging apparatus configured to form an image according to image data and to maintain information associated with performance of the imaging apparatus, a replaceable member that is mounted in the imaging apparatus and used for forming an image, a consumed amount calculation unit configured to calculate a usage value of the replaceable member, and a notification control unit configured to control a replacement notification. Wherein, the notification control unit controls a timing of the replacement notification based on the usage value calculated by the consumed amount calculation unit and the information associated with performance of the imaging apparatus.

Further, the image forming device that relates to the present invention includes an imaging apparatus configured to form an image according to image data and to maintain information associated with performance of the imaging apparatus, a consumable member that is used for image forming, a consumed amount calculation unit configure to calculate a consumption value of the consumable member; and a notification control unit configured to control a replacement notification. Wherein, the notification control unit controls a timing of the replacement notification based on the consumption value and the information associated with the performance of the imaging apparatus.

According to the image forming device that relates to the present invention, the display control of toner low or toner out warnings is modified according to the status of use of the image forming device. Therefore, excellent image quality can be maintained until the toner cartridge is replaced.

DETAILED DESCRIPTION OF THE PREFERRED EMBODIMENT

Preferred embodiments that relate to an image forming device of the present invention are described hereafter with reference to drawings. In addition, the image forming device of the present invention is not restricted to the following description, and it may be modified appropriately without departing from the scope of the invention.

First Embodiment

An image forming device that relates to the first embodiment modifies the display timing of toner low and toner out warnings based on the image area ratio of image data. Such an arrangement prevents degradation of the quality of the developed image even if printing of image data in which the image area ratio is either low or high is repeated when the remaining toner within the process cartridge is low.

Figure 1:
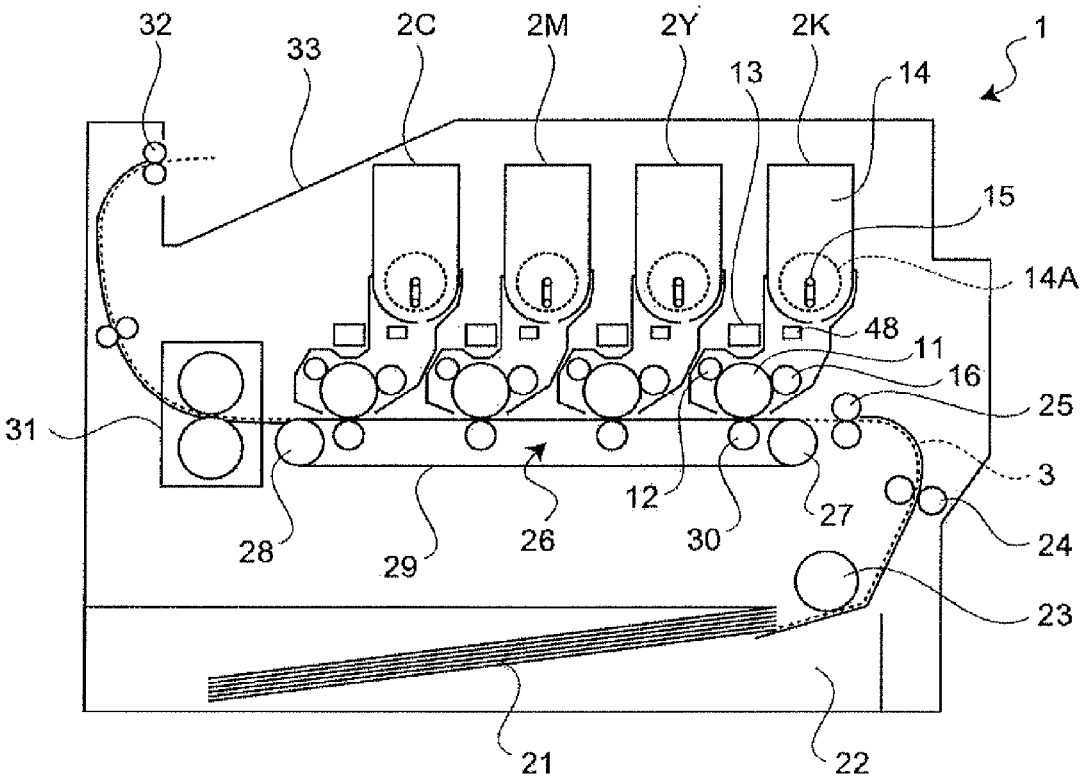
FIG. 1 is a diagram schematically illustrating an image forming device of the first embodiment.

First, a description is given regarding the image forming device 1 of the present embodiment. FIG. 1 shows a diagram of the image forming device 1, and FIGS. 2A-2C and FIGS. 3A-3C show diagrams of the remaining toner detecting mechanism 35 provided within the image forming device 1.

The image forming device 1 includes process cartridges 2C, 2M, 2Y, and 2K for printing on a recording medium 21 based on the image information corresponding to cyan, magenta, yellow and black colors. A paper carrying pathway 3 is approximately S-shaped. A stacker 33 is the final point at which the recording medium 21, on which image information is printed is discharged. The paper feed cassette is the starting point for the paper.

First, the process cartridges 2C, 2M, 2Y, and 2K that are provided within the image forming device 1 will be described. In addition, the process cartridges 2C, 2M, 2Y, and 2K are the same for the most part, so these are referred to as the process cartridge 2 in the following descriptions. Further; the process cartridge 2 serves as an image forming means (or imaging apparatus). The process cartridge 2 includes the following:

a photoconductor drum 11 for supporting an electrostatic latent image based on image information, an electrostatic roller 12 for storing an electrical charge on the surface of the photoconductor drum 11, an LED head 13 provided in the image forming device 1 body for irradiating a light corresponding to image information on the surface of the photoconductor drum 11, a toner cartridge 14 for containing toner 34, a stirring shaft 15 for stirring toner 34 within the toner cartridge 14, a developing roller 16 for developing an electrostatic latent image on the surface of the photoconductor drum 11 by toner 34, and a remaining toner detecting mechanism 35 for detecting the remaining toner 34 within the toner cartridge 14.

Further, the process cartridge 2 is arranged in a removable manner to the image forming device 1. A detailed description regarding each member included in the process cartridge 2 follows with reference to FIG. 1. Moreover; a detailed description of the remaining toner detecting mechanism 35 is given with reference to FIGS. 2A-2C and FIGS. 3A-3C in addition to FIG. 1.

The photoconductor drum 11 supports a developed image, and it is constructed so that an electric charge can be stored on the surface in order to support an electrostatic latent image based on image information. In addition, the photoconductor drum 11 is cylindrical and has the ability to rotate. The photoconductor drum 11 has a photosensitive layer consisting of a photoconductive layer and charge transporting layer in a conductive base layer, which is composed of aluminum or the like. Further, the electrostatic roller 12 is for uniformly storing the electrical charge in the surface of the photoconductor drum 11 by applying a prescribed positive voltage or negative voltage on the surface of the photoconductor drum 11 using an electrical power source, which is not illustrated. The electrostatic roller 12 is provided with the ability to rotate while contacting the surface of the photoconductor drum 11 by a fixed pressure. The electrostatic roller 12 is constructed so that a conductive metallic shaft is covered by a semi-conductive rubber such as silicone. Furthermore, the LED head 13 is provided at the upper part of the photoconductor drum 11 and has the ability to form an electrostatic latent image on the surface of the photoconductor drum 11 by irradiating a light corresponding to image information on the surface of the photoconductor drum 11. The LED head 13 is constructed with a combination of a plurality of LED elements, lens arrays, and LED driving elements.

The toner cartridge 14 is a replaceable member. More specifically, the toner cartridge 14 is a container to hold toner 34 and is arranged at the upper side of the developing roller 16. The toner cartridge 14 is freely removable firm the process cartridge 2 when the toner 34 has been consumed. Further, a stirring shaft 15 is provided within the toner container 14A of the toner cartridge 14 with the ability to rotate to stir the toner 34. In addition, the stirring shaft 15 is composed of a hard material. For instance, the side part is formed of a rod-like unit in nearly a cylindrical shape, or a side part is formed of a plate-like unit in nearly a rectangular shape. Further, the developing roller 16 is a developing unit for forming a toner layer on the photoconductor drum 11 and has the ability to rotate while contacting the surface of the photoconductor drum 11 with a fixed pressure. The developing roller 16 transfers toner 34 while rotating and develops an electrostatic latent image on the surface of the photoconductor drum 11 by the toner 34. The developing roller 16 is constructed by covering a metallic shaft, which is electrically conductive, with semi-conductive urethane rubber or the like.

The remaining toner detecting mechanism 35 is provided within the process cartridge 2 to detect the remaining toner 34 within the toner cartridge 14. In addition, the mechanism judges whether the toner is out or low, as described later, based on the remaining toner 34 that is detected by the remaining toner detecting mechanism 35. A detailed description follows regarding each constituent member of the remaining toner detecting mechanism 35 with reference to FIGS. 2A-2C and FIGS. 3A-3C in addition to FIG. 1.

First, an outline of the construction of the remaining toner detecting mechanism 35 will be described with reference to FIGS. 2A through 2D. A remaining toner detecting unit 48 is arranged in the process cartridge 2 at the lower part of the toner container 14A. Further, the stirring shaft 15 is provided in the toner container 14A. The stirring shaft 15 stirs toner 34 via a stirring unit 15B on one end of the stirring shaft 15 by rotating a rotation axis unit 15A that is on the other end of the stirring shaft 15. In addition, a gear 15C is provided at the rotation axis unit 15A, and the stirring shaft 15 rotates clockwise at a fixed rate in FIG. 2A, for example, by contacting a protruding segment 15D, which rotates at a fixed rate and is provided at the gear 15C. However, when the stirring shaft 15 moves to the solid line from the dotted line shown in FIG. 2B, the stirring shaft 15 rotates by its own weight at a quicker rate than the rotation of the protruding segment. Further, the remaining toner detecting unit 48 detects the remaining toner within the toner cartridge 14 by detecting the rotation cycle of the stirring unit 15B. For instance, a remaining toner level of 40% (quantity used 60%) can be detected. The remaining toner detecting unit 48 changes to ON state when the stirring unit 15B approaches to a point within a predetermined distance of the remaining toner detecting unit 48. On the other hand, the unit 48 changes to OFF state when the stirring unit 15B is out of the range of the predetermined distance. The rotation cycle of the stirring unit 15B is defined as a period from the time of switching from the OFF state to the ON state (when the stirring unit 15B approaches the remaining toner detecting unit 48) until a subsequent switching to the ON state from the OFF state (when the stirring unit 15B moves away from the remaining toner detecting unit 48).

Descriptions regarding the toner cartridge 14 follow separately for the cases in which the remaining quantity of toner 34 in the toner container 14A is plentiful and the remaining quantity of toner 34 in the toner container 14A is a relatively small quantity, or at a low level.

Figures 2A, 2B, 2C, 2D:
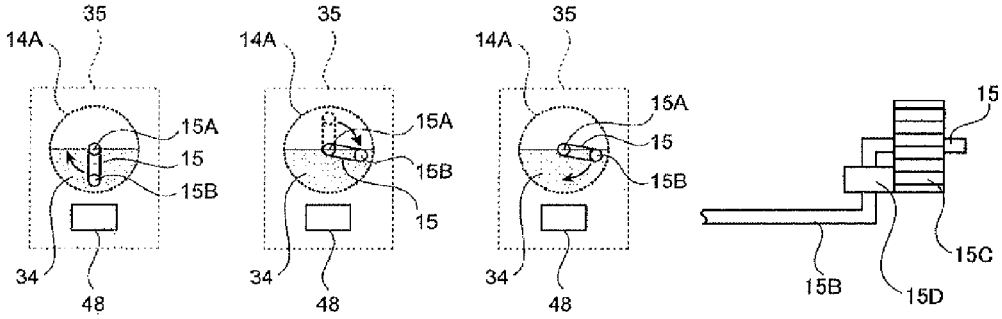
FIGS. 2A, 2B, and 2C are block diagrams illustrating a remaining toner detecting mechanism when remaining toner within the toner cartridge is plentiful in the image forming device of the first embodiment.
FIG. 2D is a partial schematic view of a stirring shaft.

First, when the remaining level of toner 34 in the toner container 14A is plentiful, the stirring shaft 15 within the toner container 14A rotates in order of FIGS. 2A-2C having the rotation axis unit 15A as the pivot, and freefalls in FIG. 2B; however, because the remaining level of toner 34 in the toner container 14A is plentiful, the stirring shaft 15 stops in toner 34, as shown in FIG. 2C, and finally rotates within the toner 34 when pushed by the protruding segment, which is rotated at a fixed rate. The remaining quantity of toner 34 is detected by the remaining toner detecting unit 48. In other words, when the remaining level of toner 34 is plentiful, as shown in FIGS. 2A-2C, the rotation cycle of the stirring unit 15B is the same as the rotation cycle of the protruding segment.

Figure 3A:
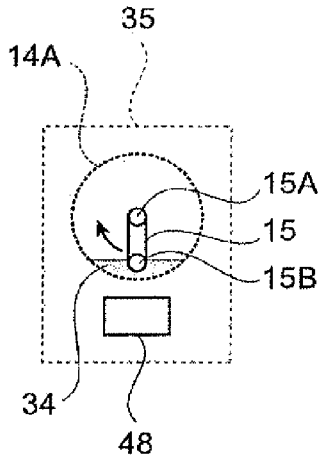
FIGS. 3A, 3B, and 3C are block diagrams illustrating the remaining toner detecting mechanism when remaining toner within the toner cartridge is a small quantity in the image forming device of the first embodiment.
Figure 3B:
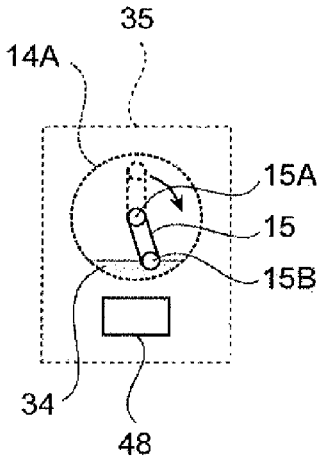
Figure 3C:
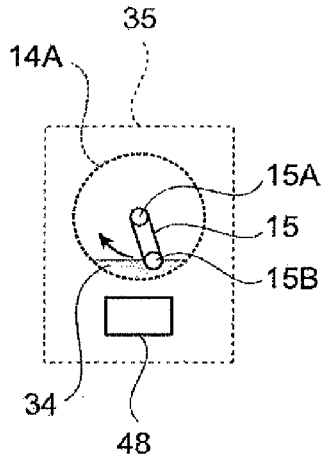

Next, a description will be given with reference to FIGS. 3A-3C for when the remaining quantity of toner 34 within the toner container 14A is a small quantity. The stirring shaft 15 within the toner container 14A rotates in order of FIGS. 3A, 3B, and 3C and has the rotation axis unit 15A as the pivot. In this case, the stirring shaft freefalls in FIG. 3B. In the case of FIG. 3B, because the remaining quantity of toner 34 within the toner container 14 A is a small quantity, the rotation axis unit 15A falls to the lower part as shown in FIG. 3B and FIG. 3C. The remaining toner is detected by the remaining toner detecting unit 48. In the case of FIGS. 3A-3C, the rotation cycle of the stirring unit 15B is shorter than the rotation cycle of the protruding segment.

As described above, the cycle detected by the remaining toner detecting unit 48 depends upon the remaining quantity of toner 34. Therefore, the remaining quantity of toner 34 can be measured by detecting the rotation cycle of the stirring unit 15B.

Next, a description is given in regards to the paper carrying pathway 3 provided within the image forming device 1. The paper carrying pathway 3 begins at a paper feed cassette 22 and leads to a hopping roller 23, a resist roller 24, a resist roller 25, a transferring belt unit 26, a transfer roller 30, a fixing unit 31, a discharge roller 32, and a stacker 33 as the final point. A detailed description follows regarding each constituent member contained in the paper carrying pathway 3 with reference to FIG. 1.

A recording medium 21 is recording paper with a fixed size in order to develop color or black-and-white image information and is generally paper such as recycled paper, glossy paper, premium grade paper, or overhead projector (OHP) film. Further, the paper feed cassette 22 holds a plurality of recording media 21, and feeds each recording medium 21 into the image forming device 1 when the print action is initialized. In addition, the paper feed cassette 22 is removable from the image forming device 1. Further, the hopping roller 23 is for feeding the recording media 21 by feeding sheets one at a time from the paper feed cassette 22 to the resist roller 24 and the resist roller 25 by rotating in a pressed condition against the recording media 21 stored in the paper feed cassette 22. Furthermore, the resist roller 24 and the resist roller 25 each sheet of recording medium 21 from the hopping roller 23 to the transferring belt unit 26.

The transferring belt unit 26 is a unit composed of a driven roller 27, a drive roller 28, and an endless transfer belt 29. Further, the driven roller 27 and drive roller 28 are provided at opposite ends of the transfer belt 29 and apply a fixed tension to the transfer belt 29. The driven roller 27 and the drive roller 28 are each formed by a high frictional resistance member. When the driven roller 27 and the drive roller 28 are rotated by a driving system (not shown), the transfer belt 29 is simultaneously operated and driven. Further, the transfer belt 29 serves as a carrying means for developing image information by carrying the recording medium 21 to the process cartridge 2 and is an endless belt so that the recording medium 21 adheres to the circumference surface of the transfer belt 29. The transfer roller 30 is placed at the lower part of the photoconductor drum 11 and is provided with the ability to rotate when the recording medium 21 is held between the transfer roller 30 and the photoconductor drum 11. Bias voltage, which has a polarity opposite to that of the toner charge, is supplied to the transfer roller 30, and the toner image formed on the surface of the photoconductor drum 11 is transferred onto the recording medium 21.

The fixing unit 31 includes a heat roller and backup roller. The heat roller and backup roller are arranged to hold the recording medium 21, which is carried by the transfer belt 29 between them and fixes the toner image developed on the recording medium 21 at the process cartridge 2 onto the recording medium 21. More specifically, the toner image adhered to the recording medium 21 is melted by using heat supplied from a heat source such as a halogen lamp, not shown, that is arranged within the heat roller, and then the toner image is fixed onto the recording medium 21 by the welding pressure of the backup roller. Further, the discharge roller 32 is for discharging to the stacker 33 the recording medium 21 in which the toner image has been fixed by the fixing unit 31. Furthermore, the stacker 33 is a storage space for holding discharged recording media 21 on which the image information has been developed.

Figure 4:
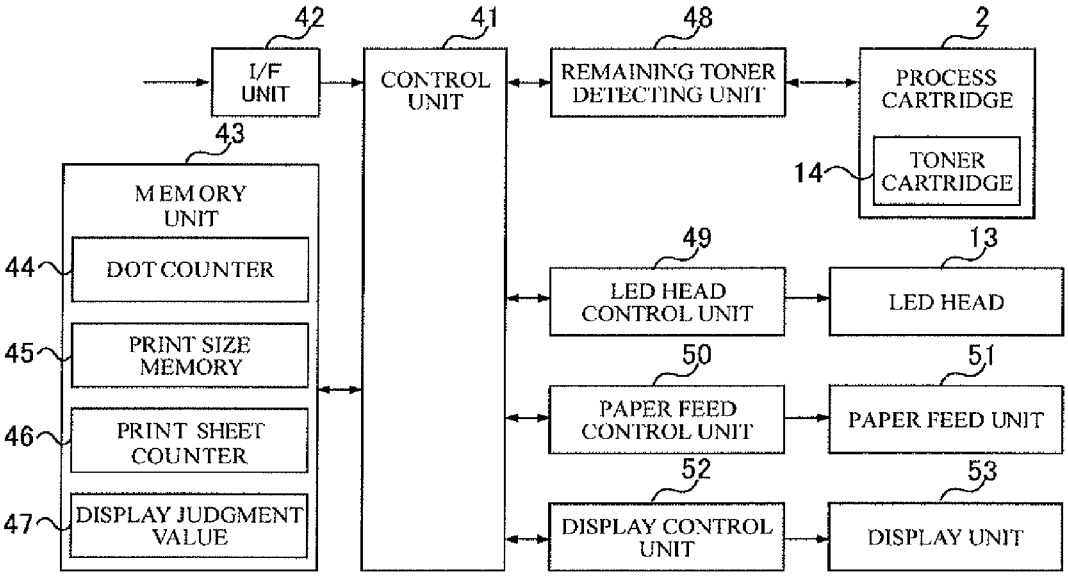
FIG. 4 is a block diagram illustrating a control apparatus that relates to replacement of the toner cartridge in the image forming device of the first embodiment.

Next, a description will be given in regards to the control that relates to the replacement of the toner cartridge 14 provided within the image forming device 1 of the present embodiment. FIG. 4 is a block diagram illustrating the control that relates to the toner cartridge 14 replacement. The image forming device 1 provides a control unit 41, which is constituted by a microprocessor, a CPU, ROM, RAM, an input-output port, a timer, or the like, and a series of processes are controlled for developing the image information on the recording medium 21 by a command from the control unit 41. In addition, the control unit 41 is also a consumed amount calculation unit for calculating the quantity of toner 34 used. Further, the control unit 41 is mutually connected with an interface unit (I/F) 42, a memory unit 43, a remaining toner detecting unit 48, an LED head control unit 49, a paper feed control unit 50, and display control unit 52. A detailed description follows regarding each constituent member mutually connecting with the control unit 41 with reference to FIG. 4.

The interface unit (I/F) 42 receives the image data from a higher-level device such as a personal computer (not shown) and sends the data to the control unit 41. Further, the memory unit 43 includes a dot-counter 44, a print size memory 45, a print sheet counter 46, and display judgment value 47. In addition, the dot-counter 44 counts the number of dots of the LED head 13 lit according to the image data from the time when the toner cartridge 14 was last replaced, and stores the cumulative number of dots in the memory unit 43. Furthermore, the print size memory 45 reads and stores the print size information contained in the image data that is received by the control unit 41. The print sheet counter 46 counts the number of printed sheets of the recording medium 21 from the time when the toner cartridge 14 was last replaced and stores the cumulative number of printed sheets in the memory unit 43. In addition, the cumulative number of printed sheets is stored in the memory unit 43 as the cumulative print number converted to A4 size by converting the print size stored in the print size memory 45 into A4 size prints. The display judgment value 47 is the threshold for determining whether or not the toner 34 held in the process cartridge 2 is in a toner low state or a toner out state. In addition, the display judgment value 47 depends on the image print ratio of the image data.

Further, the remaining toner detecting unit 48 detects the remaining quantity of toner 34 in the toner cartridge 14 mounted in the process cartridge 2. The LED head control unit 49 controls the light emitting action of the LED head 13 based on a command from the control unit 41. The paper feed control unit 50 controls the paper feed action of the paper feed unit 51 based on commands from the control unit 41. Furthermore, the display control unit 52 is a notification control unit, which controls a display unit 53 for displaying the remaining quantity of toner 34 and a performance condition associated with the image forming device 1 based on commands from the control unit 41. More specifically, when the quantity of available toner 34 in the toner cartridge 14 is at a predetermined threshold level or less, the indication light indicating the toner low state is lit in the display unit 53. Likewise, when the available toner 34 in the toner cartridge 14 is out, the indication light indicating the toner out state is lit on in the display unit 53.

Figure 5:
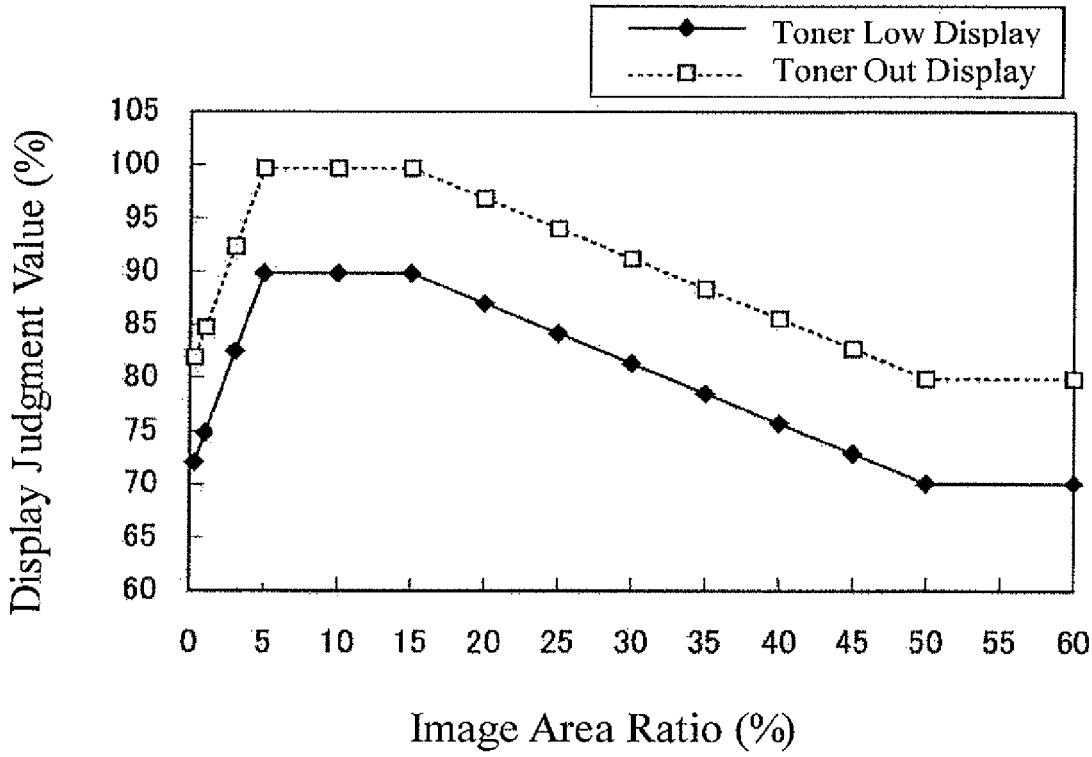
FIG. 5 is a graph illustrating a display judgment value in relation to the image area ratio in an image forming device of the first embodiment.

Next, a description will be given regarding the timing of replacement of the toner cartridge 14 mounted in the process cartridge 2. FIG. 5 is a graph showing a relationship of the display of the toner low state and the toner out state associated with the display judgment value 47 in relation to the image area ratio.

First, a description will be given regarding the supply of toner 34 within the image forming device 1. The toner 34 is supplied to the photoconductor drum 11 through the developing roller 16 from the toner cartridge 14 within the process cartridge 2. The toner cartridge 14 can hold, for instance, 100 g of toner 34, and the process cartridge 2 can hold, for instance, 40 g of toner 34. Here, the process cartridge 2 already holds 20 g, for instance, of toner 34 before the toner cartridge 14 is mounted in the process cartridge 2. In this case, when the toner cartridge 14 containing 100 g of toner 34 is mounted in the process cartridge 2, 20 g of toner 34 is supplied to the process cartridge 2 from the toner cartridge 14. Therefore, 40 g of toner 34, which is the capacity limit, is held in the process cartridge 2. Further, at that time, the total quantity of toner 34 within the image forming device 1 is 120 g. When the print action is initialized, the toner 34 is supplied to the photoconductor drum 11 from the toner cartridge 14 through the developing roller 16 within the process cartridge 2 according to the quantity of toner 34 used.

Next, a description will be given regarding a low toner state. The toner low state is a condition in which the quantity of available toner 34 within the toner cartridge 14 is at a predetermined level or below. For instance, the toner low state can be determined when the remaining quantity of toner 34 in the toner cartridge 14 is 10 g or below. At that time, a total of 50 g of toner 34 is held within the image forming device by combining 10 g of toner 34 held in the toner cartridge 14 and 40 g of toner 34 held in the process cartridge 2. In addition, when toner low state occurs, the indication light for toner low warning is lit in the display unit 53 of the image forming device 1. Further, the toner out state is a condition in which there is no available toner 34 remaining. The toner out state is judged when all 100 g of toner 34 held in the toner cartridge 14 has been consumed. At that time, the process cartridge holds 20 g of toner 34. In addition, when the toner out state occurs, the indication light warning of the toner out state is turned on in the display unit 53 of the image forming device 1.

Next, a display judgment value 47 and the image area ratio shown in FIG. 5 will be described. The display judgment value 47 represented by the vertical axis of FIG. 5 is the threshold value used to judge whether or not toner 34 within the toner cartridge 14 is in a toner low state or a toner out state. Further, the image area ratio represented by the horizontal axis of FIG. 5 is defined by the ratio of the number of dots that are lit in the LED head 13 in the actual print action when the number of dots of the LED head 13 for illumination is regarded as 100 in cases printing a solid image where the toner concentration becomes 100% in the entire printable area of the recording medium 21.

To be more specific, the image area ratio is calculated by multiplying by 100, a value representing a cumulative dot count since the toner cartridge 14 was replaced divided by a result of multiplying the number of dots in the printable area per page of A4 size by the cumulative number of printed copies. In other words, the image area ratio becomes the mean value of the image area accounting for printable area of the entire recording media 21, which is converted to A4 size, since replacing the toner cartridge 14. Specifically, the image area ratio is calculated by the numerical formula 1 below.

$$\text{Image area ratio}[\%]=\{X1/(X2\times X3)\}\times 100 \qquad \text{[Numerical Formula 1]}$$

wherein, X1 represents the cumulative dot count, X2 represents the cumulative number of printed copies, and X3 represents the number of dots of printable area per page of A4 size sheet.

Further, the image area ratio may be calculated based on, for example, the N most recent print jobs, where N is an integer (for example, N is 100). By using this method, the image area ratio can be determined in accordance with the tendency of image data in the most recent print jobs. In addition, the image area ratio in this case is calculated by the numerical formula 2.

$$\text{Image area ratio}[\%]=\{Y1/(Y2\times Y3)\}\times 100 \qquad \text{[Numerical Formula 2]}$$

wherein, Y1 represents the cumulative dot count of the N most recent print jobs, Y2 represents the cumulative number of printed copies of the N most recent print jobs, and Y3 represents the number of dots of printable area per page of A4 size.

Otherwise, an estimated value may be set to the image area ratio by statistically estimating the image area ratio of a future print job from the transition of the image area ratio of a print job after replacing the toner cartridge 14 until the current point in time.

Next, a description will be given regarding the setting of the display judgment value 47 associated with the decrease of toner 34 within the image forming device 1. In addition, conventionally, 5% has been the standard condition for the image area ratio of image data. Descriptions will be given hereafter separately for three cases in which the image area ratio is from 5% through 15%, for when the image area ratio of the image data is less than 5%, and when the image area ratio exceeds 15%.

First, a description will be given for a case when the image area ratio is from 5% through 15%. When the image area ratio is in the range between 5% and 15%, the judgment value of the image area ratio is based on, for example, 5%. In addition, in the range in which the image area ratio is between 5% and 15%, the judgment value is set so as to use toner 34 within the process cartridge as far as possible because the printing grade of the image developed on the recording medium 21 is excellent until the toner is out. More specifically, in the range in which the image area ratio is between 5% and 15%, the display judgment values 47 for the toner low state and the toner out state are as follows. The display judgment value 47 for the toner low state is based on the quantity of toner 34 when the quantity of toner 34 used in the toner cartridge 14 reaches, for example, 90%. To be more specific, if the cartridge 14 that can hold 100 g of toner 34 is used, for example, the base is when 90 g of toner 34 is used and the remaining toner 34 is 10 g. Likewise, the display judgment value 47 of the toner out state is based on the quantity of toner 34 when the quantity of toner 34 used in the toner cartridge 14 reaches, for example, 100%. To be more specific, if the cartridge 14 that can hold 100 g of toner 34 is used, for example, the threshold for determining when the toner is out is when the remaining toner 34 reaches zero by using all 100 g of toner 34.

Next, a description will be given for a case when the image area ratio of image data is less than 5%. When the image area ratio of the image data is low, toner 34 that is not developed via the photoconductor drum 11 from the developing roller 16 receives damage due to stirring repetition and rotation friction of the developing roller 16, toner supply roller, and the like when toner 34 held in the toner cartridge 14 is low. As a result, an image defect such as fogging or blotting originating in an electrostatic abnormality of toner 34 may be generated. Accordingly, in order to avoid the image defects described above, the user is urged to replace the toner cartridge 14 early by setting a higher threshold of remaining quantity of toner 34 for displaying the toner out warning. More specifically, for example, when the image area ratio is 1%, the display judgment value 47 for the toner low state and the toner out state is as follows. The toner low state display judgment value is based on the quantity of toner 34 remaining when the quantity of toner 34 used reaches, for example, 75%. Likewise, the toner out state display judgment value is based on the quantity of toner 34 remaining when the quantity of toner 34 used reaches, for example 85%. By so doing, the rate of degradation of toner within the process cartridge 2 can be lowered by urging the user to replace the toner cartridge 14 early.

The following describes a case in which the image area ratio of image data exceeds 15%. When the image area ratio is high, there is a high probability of printing a solid image in which the toner concentration is 100%, otherwise known as a patch pattern. When the remaining quantity of toner 34 is low, a solid image developed on the recording medium 21 is liable to appear scratched. Accordingly, in order to avoid a scratchy developed image, of the user is urged to replace the toner cartridge 14 early by raising the threshold for the remaining quantity of toner 34 that triggers the toner out warning. More specifically, for example, when the image area ratio is 50%, the toner low display judgment value is based on the quantity of toner 34 when the quantity of toner 34 used reaches, for example, 70%. Likewise, the toner out display judgment value is based on the quantity of toner 34 remaining when the quantity used of toner 34 reaches, for example 80%.

As described above, in a case when the range of the image area ratio of image data is between 5% and 15%, the toner low display judgment value is based on the quantity of toner 34 when the quantity of toner 34 used reaches 90%. Likewise, the toner out display judgment value is based on the quantity of toner 34 when the quantity of toner 34 used reaches 100%. Further; in a case when the image area ratio is less than 5% or exceeds 15%, the toner low display judgment value and toner out display judgment value are lowered (the threshold amount of remaining toner is raised). Accordingly, the printing grade of the image developed on the recording medium 21 will be stable without depending upon the image area ratio of image data.

Figure 6:
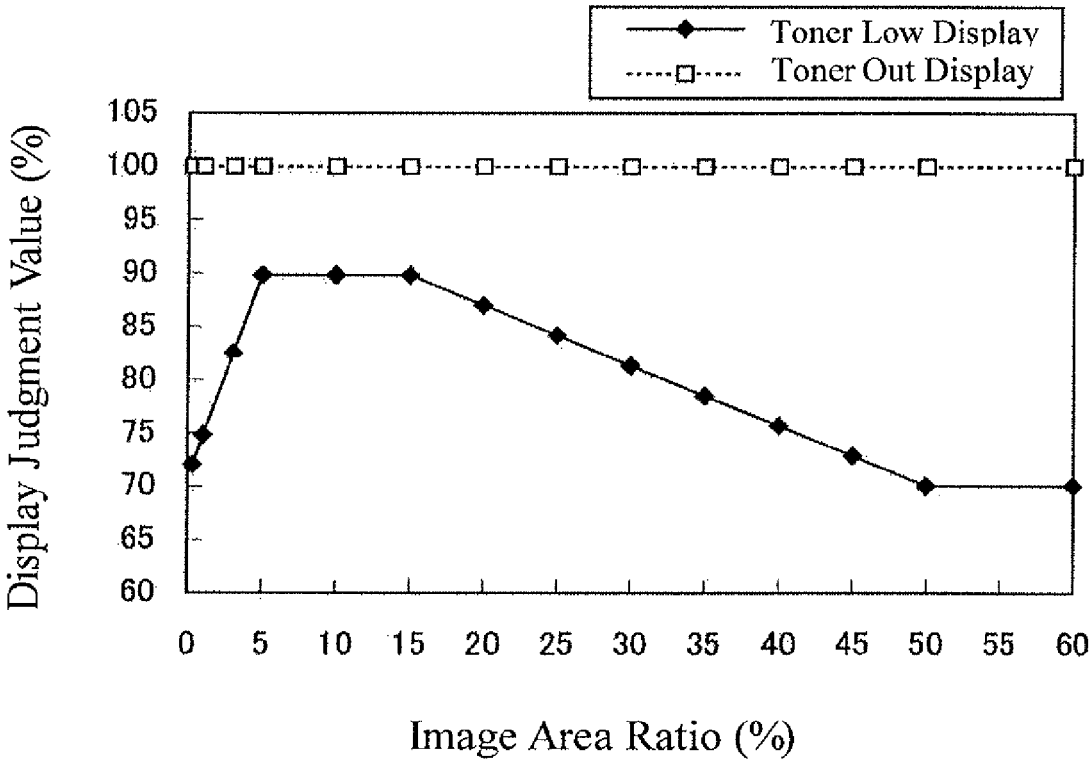
FIG. 6 is a graph illustrating a display judgment value in relation to the image area ratio in an image forming device of the first embodiment.

The relationship of the toner low display and toner out display criteria associated with the display judgment value 47 in relation to the image area ratio described with reference to FIG. 5 is only an example. Therefore, the relationships are not limited to those described above with reference to FIG. 5, and it is possible to suitably modify the relationships without departing from the present inventive concepts thereof. For example, as illustrated in FIG. 6, the toner low display judgment value may depend upon the image area ratio; however, the toner low display judgment value may be based on the quantity of toner 34 within the process cartridge 2 when the quantity of toner 34 used reaches, for example 100% without regard to the image area ratio. Even in such case, a toner low warning is issued to the user of the image forming device 1 before degradation of the quality of the image developed on the recording medium 21 occurs. Further, the setting of the capacity of toner 34 and the remaining quantity of toner 34 within the toner cartridge 14 and the process cartridge 2 is merely exemplary. Therefore, the numerical values described above are not limiting, and it is possible to suitably modify such values without departing from the present inventive concepts thereof. In addition, the remaining toner detecting mechanism 35 is provided within the toner cartridge 14 may be provided within the process cartridge 2.

Figure 7:
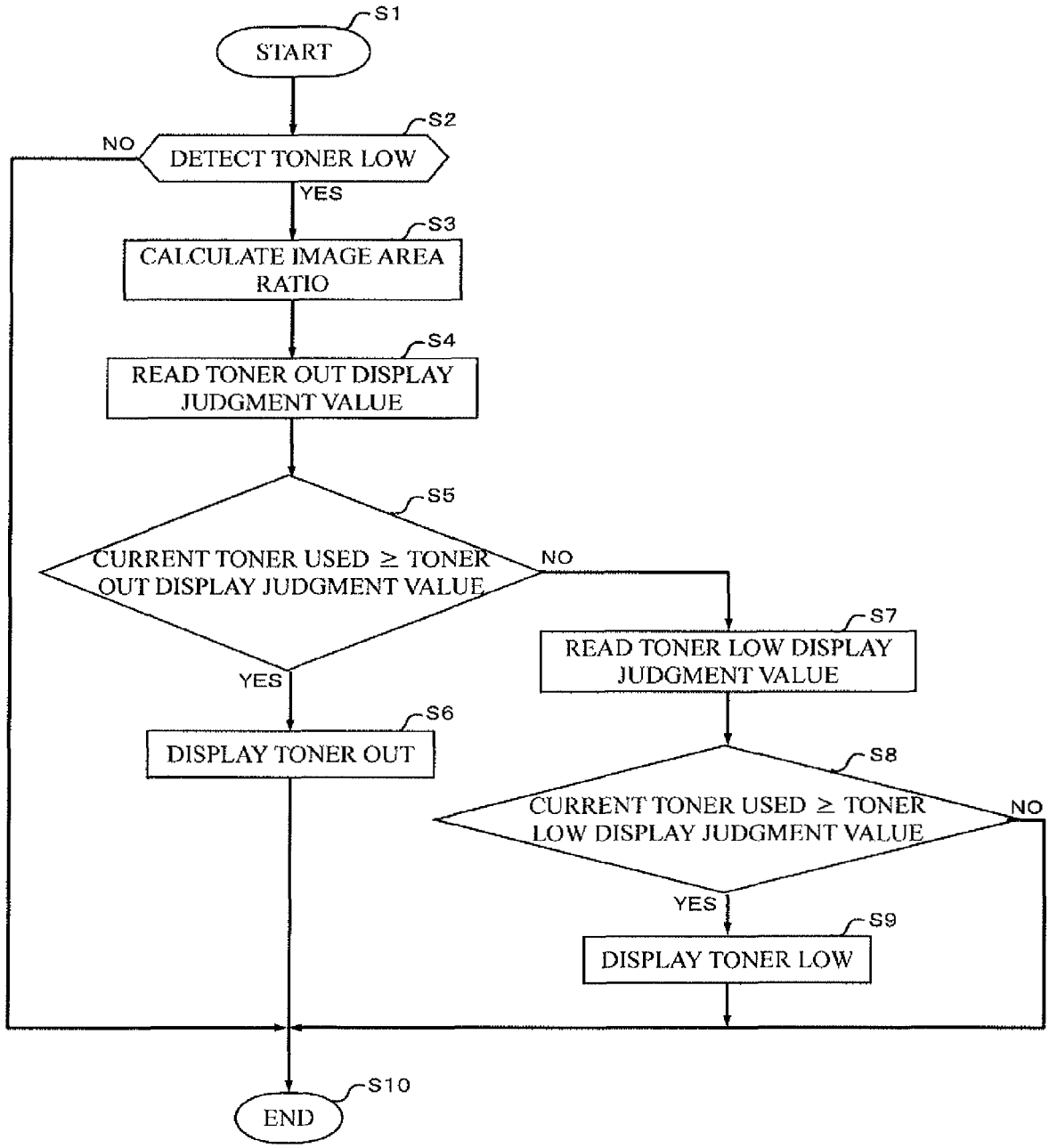
FIG. 7 is a flow diagram illustrating the order of operation that relates to replacing the toner cartridge in an image forming device of the first embodiment.

Subsequently, a description will be given in regards to the action associated with replacement of the toner cartridge 14 of the present embodiment. FIG. 7 illustrates a flow diagram of the action associated with replacement of the toner cartridge 14.

When a print job completes in the image forming device 1, a replacement display judging sequence is initiated by a command from the control unit 41 for judging whether or not information associated with replacement of the toner cartridge 14 is displayed in the display unit 53 of the image forming device 1 (S1).

First, the remaining quantity of toner 34 in the toner cartridge is detected at the remaining toner detecting unit, and the process proceeds to S3 if the remaining quantity of toner 34 is at or below the threshold level for the low toner state (Yes at S2), and the process terminates when the remaining quantity of toner 34 is more than the threshold level (No at S2). In addition, in the present embodiment, the threshold level of the remaining quantity of toner 34 in the toner cartridge 14 can be set in advance in accordance with each image forming device 1 or use environment. For this reason, the threshold level of the remaining quantity of toner 34 is regarded to be, for example, 40%. In this case, when the quantity used of toner 34 reaches 60%, the remaining toner detecting unit 48 detects the toner low state in the toner cartridge 14 (S2).

Next, when proceeding to S3, the image area ratio of all image data since replacing the toner cartridge 14 is calculated (S3) by a command from the control unit 41.

Next, the toner out display judgment value is read from the memory unit 43 based on the image area ratio. For example, the display judgment value 47 for the toner out state when the image area ratio is 5% is based on the quantity of toner 34 remaining when the quantity of toner 34 used in the toner cartridge 14 reaches, for example, 100%. Accordingly, if the cartridge 14 can hold, for example, 100 g of toner 34, the toner out threshold will be reached when the remaining quantity of toner 34 reaches zero by using all 100 g of toner 34 (S4).

Next, when the current toner usage (cumulative dot count value×the toner usage per dot/toner quantity in the toner cartridge) corresponds to the toner out display judgment value or above (Yes at S5) by comparing the cumulative dot count value since replacing the toner cartridge and toner out display judgment value, the control unit 41 proceeds to step S6, and when the current toner usage is less than the toner out display judgment value (No at S5), to the sequence proceeds to step S7 (from S5).

If step S6 is performed because the current toner usage value is greater than or equal to the toner out display judgment value, the user is urged to replace the toner cartridge 14 by a command from the control unit 41, which lights the toner out display in the display unit 53. Then, the replacement display judging sequence terminates.

Next, when step S7 is preformed because the current toner usage value is less than the toner out display judgment value, the toner low display judgment value is read from the memory unit 43 based on the image area ratio according to the command from the control unit 41. For example, the toner low display judgment value when the image area ratio is 5% is based on the quantity of toner 34 when the quantity of toner 34 consumed in the toner cartridge 14 reaches 90%. Accordingly, in step S7, if using the cartridge 14 that can hold, for example, 100 g of toner 34, the threshold will be reached at the moment when the remaining quantity of toner 34 reaches 10 g by using 90% of toner 34.

Next, when the current toner usage (cumulative dot count value×the toner usage per dot/toner quantity in the initial toner cartridge) is greater than or equal to the toner low display judgment value (Yes at S8) by comparing the cumulative dot count value and toner low display judgment value since replacing the toner cartridge 14, the control unit 41 proceeds to step S9. When the current toner consumption is less than the toner low display judgment value (No at S8), the procedure terminates.

When performing step S9 because the current toner consumption is greater than or equal to the toner low display judgment value, according to the command from the control unit 41, the user is urged to replace the toner cartridge 14 by lighting the toner low warning display in the display unit 53. Then, the procedure terminates.

As described above, when the replacement display judging sequence of the toner cartridge 14 completes the flow of actions associated with the replacement of the toner cartridge 14, the image forming device 1 is ready for the next print action. In other words, when the toner out warning is lit in the display unit 53 of the image forming device 1, the print action is suspended until the toner cartridge 14 is replaced. Further, when the toner low warning is lit and when no display is apparent in the display unit 53 of the image forming device 1, the print action will start when the next image data is received.

As described above, according to the first embodiment, the timing of toner low warning display and toner out warning display is modified based on the image area ratio until a judgment is made to replace the toner cartridge 14. Therefore, fogging and blotting or the like that occurs on the developed image due to the repetition of printing an image with low image area ratio in a condition in which the remaining quantity of toner 34 in the toner cartridge 14 is low, are prevented. Further, image degradation such as fogging and the like that occurs on the developed image by printing an image with a high image area ratio are prevented. Therefore, excellent image quality can be maintained on the developed print until the toner cartridge 14 is replaced.

Second Embodiment

An image forming device that relates to the second embodiment modifies the timing of displaying toner low and toner out warnings based on the prescribed environment value due to the temperature and relative humidity associated with the image forming device. Such an arrangement prevents degradation of the image quality of the developed image as a result of repeating the print actions under a condition of either high temperature and humidity or low temperature and humidity when the remaining quantity of toner within the process cartridge is low.

Figure 8:
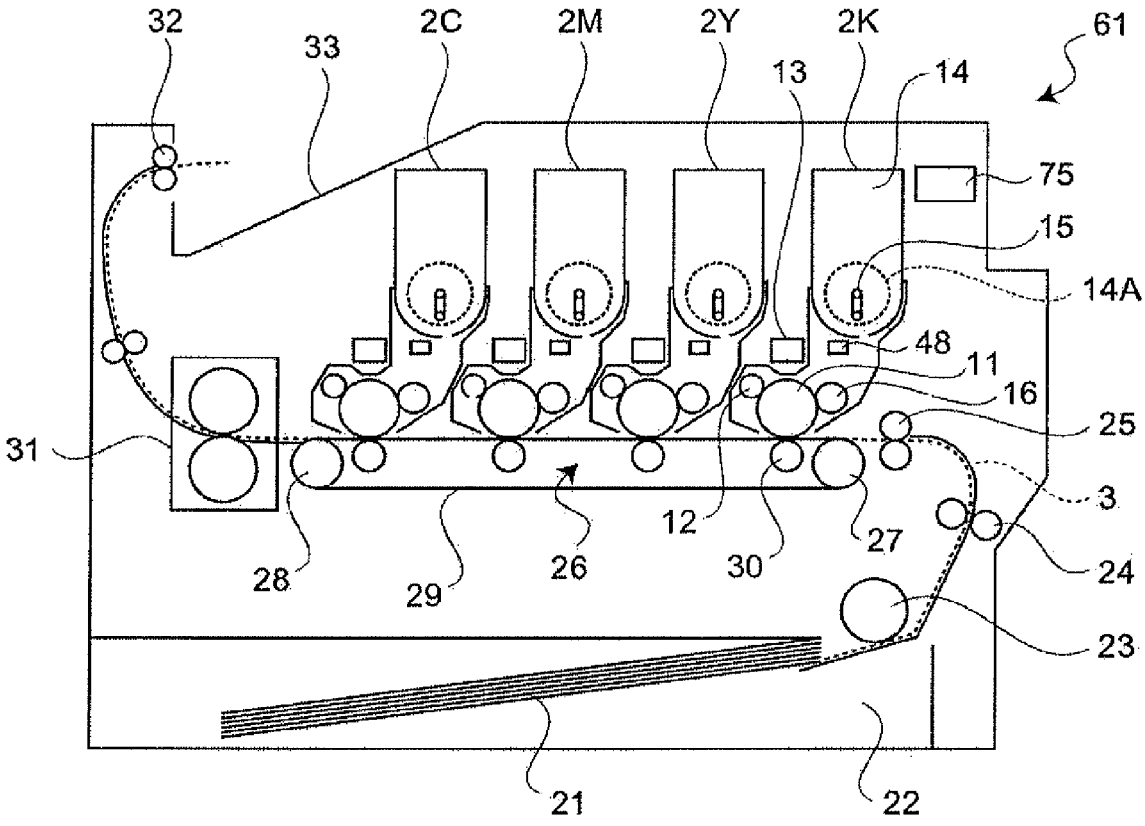
FIG. 8 is a diagram schematically illustrating an image forming device of the second embodiment.

An image forming device 61 that relates to the second embodiment of the present invention will be described with reference to FIG. 8. However, the image forming device 61 of the present embodiment has a different function in that an environmental sensor for detecting the temperature and relative humidity while the remaining construction is approximately the same in comparison with the image forming device 1 described in the aforementioned first embodiment. In addition, only the differences will be described while redundant descriptions are omitted for simplification.

First, the image forming device 61 of the present embodiment will be described. FIG. 8 illustrates a block diagram of the image forming device 61. The image forming device 61 provides an environment sensor function which has the ability to reflect the temperature as well as the relative humidity on the print action within the use environment of the image forming device 61.

The constituent members of the image forming device 61 are approximately the same as those of the first embodiment. The image forming device 61 provides an environment sensor 75 that is a unique constituent member in the second embodiment. The environment sensor 75 is provided within the image forming sensor 61 and detects temperature and humidity.

Figure 9:
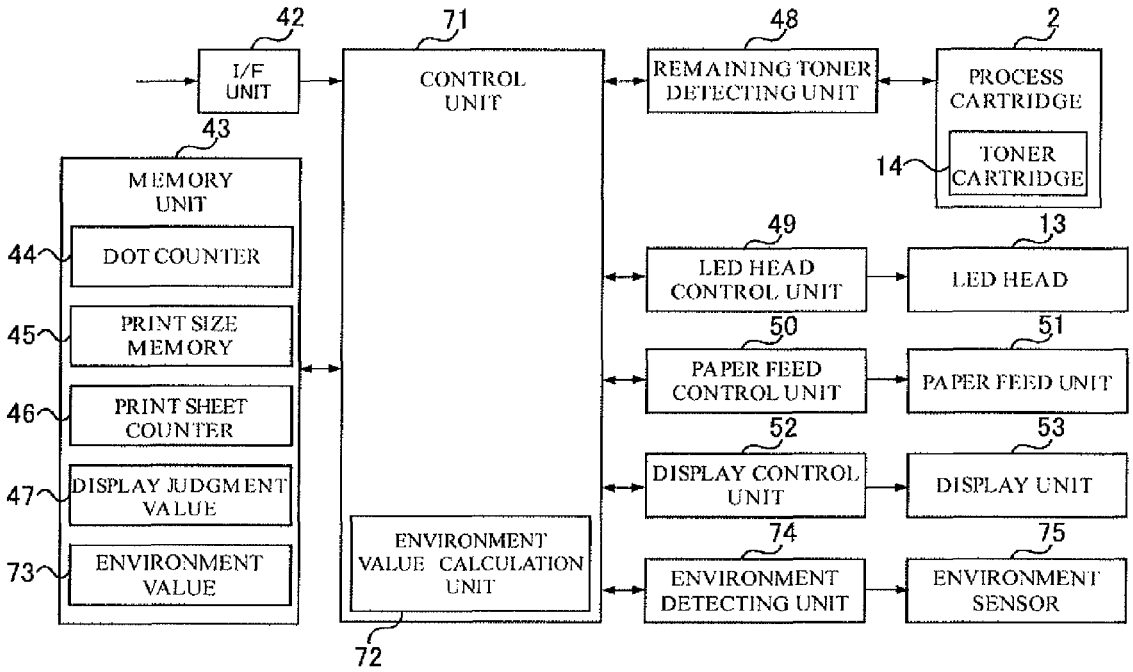
FIG. 9 is a block diagram illustrating a control apparatus that relates to replacing the toner cartridge in an image forming device of the second embodiment.

Next, a description regarding the control associated with the replacement of the toner cartridge 14 will be given. FIG. 9 illustrates the block diagram showing the constitution of the control associated with the replacement of the toner cartridge 14.

A control unit 71 mutually connects to the environment detecting unit 74 in addition to the constituent members of the first embodiment. Further, an environment value calculation unit 72 is provided within the control unit 71. Likewise, an environment value 73 is provided within a memory unit 43. Detailed descriptions will be given regarding the environment detecting unit 74, environment value calculation unit 72, and the environment value 73 with reference to FIG. 9.

The environment detecting unit 74 controls, based on the command from the control unit 71, the performance associated with the detections of temperature and relative humidity of the image forming device 61 by the environment sensor 75 and sends the temperature value and relative humidity value detected by the environment sensor 75 to the control unit 71. Further, the environment value calculation unit 72 calculates, based on a command from the control unit 71, the environment value 73 from the temperature value and the relative humidity value that are sent from the environment detecting unit 74. More specifically, the control unit 71 reads from the memory unit 43 the display judgment value 47 that is a threshold for judging whether or not a warning for urging replacement of the toner cartridge 14 is displayed based on the environment value 73 calculated by the environment value calculation unit 72. Thereafter, a judgment is made whether or not a replacement warning for the toner cartridge 14 is displayed in the display unit 53 by referring to the toner low detecting information, the cumulative dot count, and display judgment value 47 from the remaining toner detecting unit 48.

Figure 10:
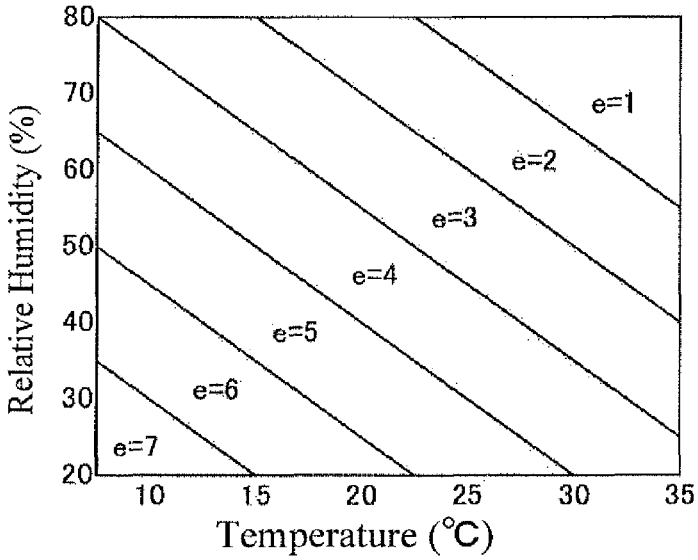
FIG. 10 is a graph illustrating the relative humidity in relation to the temperature that relates to the environment value in an image forming device of the second embodiment.
Figures 11, 12:
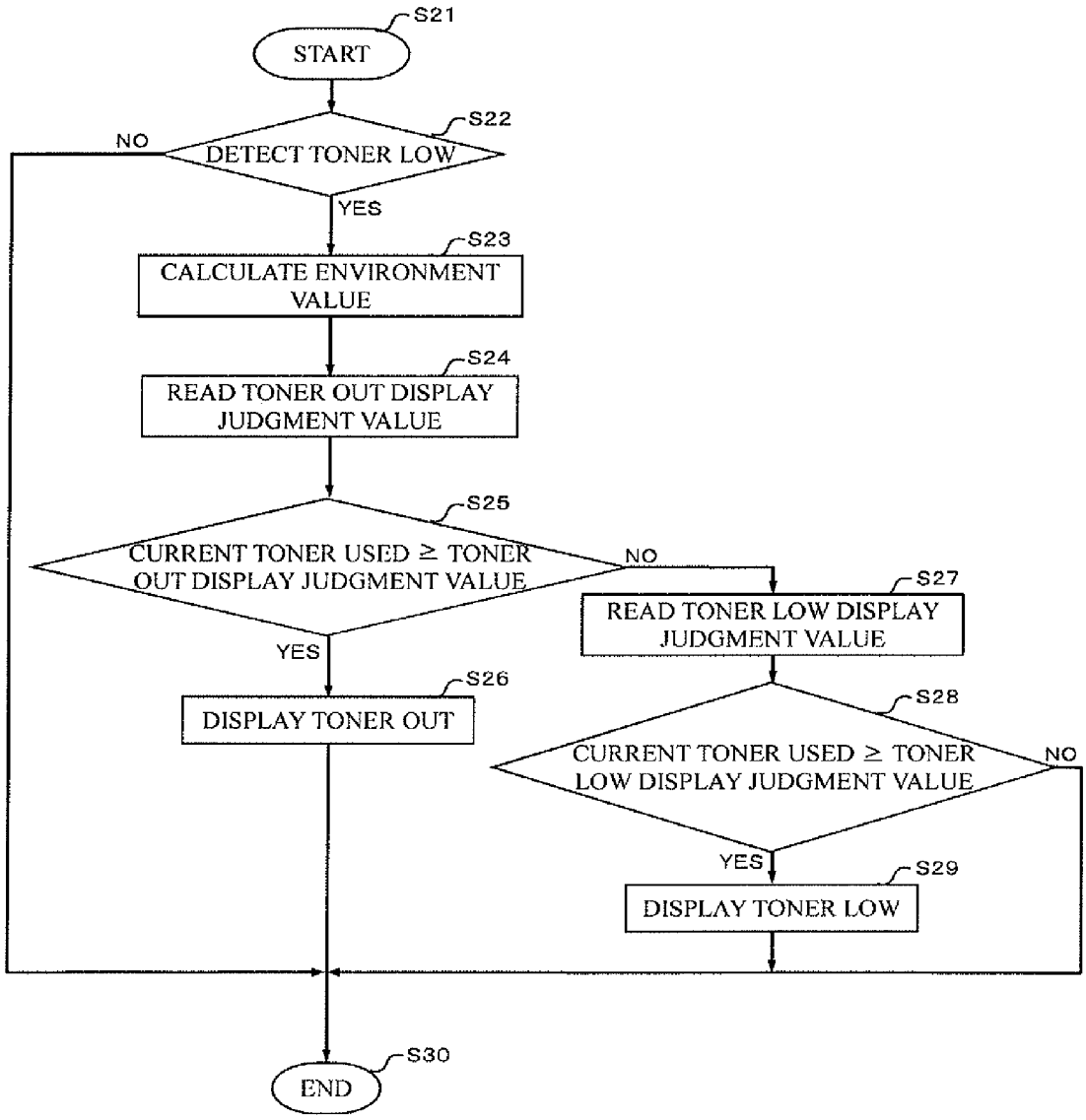
FIG. 11 is a table illustrating a toner low display judgment value and toner out display judgment value in relation to the property level in an image forming device of the second embodiment.
FIG. 12 is a flow diagram illustrating the order of operation that relates to the replacement of the toner cartridge in an image forming device of the second embodiment.

Next, a description will be given regarding the timing for replacing the toner cartridge 14 mounted in the process cartridge 2 within the image forming device 61 of the second embodiment. FIG. 10 is a graph illustrating the relationship between the temperature and relative humidity associated with the environment value 73. Further, FIG. 11 is a table illustrating the relationship between the environment value 73 and the toner low display judgment value as well as the toner out display judgment value.

As shown in FIG. 10, the environment value 73 is divided into 7 grade levels in accordance with the temperature and relative humidity. For instance, the environment value 73 is set as four (e=4) for 22° C. being the normal room temperature and 50% for the normal room humidity. Further, for instance, the environment value 73 is set as one (e=1) for 30° C. being a high temperature and 80% for a high humidity. Furthermore, for instance, the environment value 73 is set as seven (e=7) for 10° C. being a low temperature and 20% for a low humidity. In addition, the toner low display judgment value shown in FIG. 11 is the threshold in terms of the percentage of toner consumed in order to judge whether to display the toner low indication, and the toner out display judgment value is the threshold in terms of the percentage of toner consumed in order to judge for displaying toner the out indication.

Next, descriptions will be given regarding setting the environment value 73 associated with decreasing toner 34 within the image forming device 61. Descriptions follow separately for three cases in which the drive environment of the image forming device 61 is in the state of normal room temperature and humidity, high temperature and humidity, and low temperature and humidity.

First, a description follows for the case in which the drive environment of the image forming device 61 is at normal room temperature and humidity. The standard condition in the image forming device 61 is in the environment at the normal room temperature and humidity, and the environment values 73 in this case are set as three, four and five (e=3, 4, and 5). In addition, the toner low display judgment value is based on the moment when the quantity of toner 34 used reaches 90% from when the toner cartridge 14 was last replaced. Likewise, the toner out display judgment value is based on the moment when the quantity of toner 34 used reaches 100% from when the toner cartridge 14 was last replaced. In the environment condition at normal room temperature and humidity described above, the quality of the developed image is excellent, and toner 34 in the process cartridge 2 can be used as far as possible because an excellent image quality can be maintained even when the remaining quantity of toner 34 in the process cartridge 2 is low.

Next, a description will be given for a case in which the drive environment of the image forming device 61 is at a high temperature and humidity. The environment values 73 in this case are set as one and two (e=1 and 2). Both the toner low display judgment value and the toner out display judgment value are lowered (the threshold value of remaining toner is increased) when in the state of high temperature and humidity. For instance, when the environment value 73 is one (e=1), the toner low display judgment value is based on the moment when the quantity used of toner 34 reaches 70%. Likewise, the toner out display judgment value is based on the moment when the quantity used of toner 34 reaches 80%. In the environment condition at a high temperature and humidity described above, when printing in the state in which the remaining quantity of toner 34 is low within the process cartridge 2, the toner 34 that is not developed by the photoconductor drum 11 within the process cartridge 2 is liable to receive damage due to repeated stinting and friction due to rotation of the developing roller 16 or the like. As a result, image degradation such as fogging may be generated on a developed image due to dropping of the electrical charge of the toner 34. Therefore, the user is urged to replace the toner cartridge 14 by displaying toner low and toner out warnings in the display unit 53 of the image forming device 61 at a relatively early time in the environmental state of high temperature and humidity.

Next, a description will be given for a case in which the drive environment of the image forming device 61 is at a low temperature and humidity. The environment values 73 in this case are set as six and seven (e=6 and 7). Both toner low display judgment value and toner out display judgment value are lowered in a state of high temperature and humidity. For instance, when the environment value 73 is six (e=6), the toner low display judgment value is based on the moment when the quantity used of toner 34 reaches 80%. Likewise, the toner out display judgment value is based on the moment when the quantity used of toner 34 reaches 90%. In an environmental state of low temperature and humidity described above, when printing in the condition in which the remaining quantity of toner 34 is low within the process cartridge 2, the toner 34 that is not developed by the photoconductor drum 11 within the process cartridge 2 is liable to receive damage due to repeated stirring and friction due to rotation of the developing roller 16 or the like. As a result, image defects such as fogging or blotting may be generated on a developed image due to abnormality in the electrical charge of toner 34. Therefore, the user is urged to replace the toner cartridge 14 by displaying toner low and toner out warnings in the display unit 53 of the image forming device 61 at a relatively early time in the environmental state of low temperature and humidity.

As described above, the present embodiment modifies the display for the toner low display judgment value as well as the toner out display judgment value in the display unit 53 of the image forming device 61 based on the environment value 73, which is calculated from the relationships between the temperature and relative humidity. The relationships associated with toner low display and toner out display that were described with reference to FIG. 10 and FIG. 11 are exemplary. Therefore, the relationships are not limited to those described above, and it is possible to suitably modify these relationships without departing from the present inventive concepts. For instance, control of the toner low display judgment value depends on the environment value 73; however, the toner low display judgment value may be based on the quantity of toner 34 within the process cartridge when the quantity used of toner 34 in the toner cartridge reaches, for example, 100% without associating it with the environment value 73. Even in such case, a toner low warning is notified to the user of the image forming device 61 before degradation of the quality of the image developed on the recording medium 21 occurs. Further, the setting of the capacity for the toner 34 and the remaining quantity of toner 34 within the toner cartridge 14 as well as the process cartridge 2 is only an example. Therefore, the numerical values described above are not limiting, and it is possible to suitably modify the numerical values discussed above without departing from the present inventive concepts.

Subsequently, a description will be given in regards to the action associated with replacement of the toner cartridge 14 provided within the image forming device 61 of the present embodiment. FIG. 12 illustrates a flow diagram of the action associated with replacement of the toner cartridge 14.

When the print job completes in the image forming device 61, by a command from the control unit 71, a replacement display judging sequence starts for judging whether or not information associated with replacement of the toner cartridge 14 is displayed in the display unit 53 of the image forming device 61 (S21).

First, the remaining quantity of toner 34 in the toner cartridge is detected at the remaining toner detecting unit 48, and when the quantity of toner 34 consumed is greater than or equal to the threshold value (Yes at S22), the process proceeds to step S23, and when the quantity of toner 34 consumed is less than the threshold (No at S22), the process terminates. In addition, the threshold for the remaining quantity of toner 34 is regarded as, for example, 40% in the present embodiment (S22).

Next, when proceeding to step S23, the current environment value 73 is calculated. In addition, the environment value 73 is detected at the environment sensor 75, and calculated at the environment value calculation unit 72 based on the temperature value and the relative humidity value that are sent to the control unit 71 through the environment detecting unit 74 (S23).

In addition, the procedure of step S24 through step S30 corresponds to the procedure of step S4 through step S10 described in the performance flow diagram in FIG. 7 associated with the replacement of the toner cartridge 14 in the first embodiment. Therefore, the description will be omitted.

As described above, when the replacement display judging sequence of the toner cartridge 14 completes through a flow of actions associated with the replacement of the toner cartridge 14, the image forming device 61 is ready for the next print action. In other words, when the toner out warning is lit in the display unit 53 of the image forming device 61, the print action is suspended until the toner cartridge 14 is replaced. Further, when toner low warning is lit and when no display is apparent in the display unit 53 of the image forming device 61, the print action starts again when the next image data is received.

As described above, according to the second embodiment, the display timing for toner low as well as toner out is modified based on the environment value 73 that is set by the temperature and relative humidity that relates to the image forming device 61 at the moment in which the replacement of the toner cartridge 14 is judged. Therefore, fogging that occurs on the developed image due to printing under a state of high temperature and humidity is prevented even when the remaining quantity of toner 34 in the toner cartridge 14 is low. Further, image degradation such as blotting and the like that occurs on the developed image by printing under a state of low temperature and humidity is prevented. Accordingly, excellent image quality can be maintained on the developed print until the moment when the toner cartridge 14 is replaced.

In addition, in the second embodiment, because the transfer ratio changes depending upon the thickness of the paper of the recording medium 21, the display timing associated with the information for replacing the toner cartridge 14 may be modified by taking into consideration the thickness of the paper of the recording medium 21 with a high frequency of use by the user.

Further, when the image forming device 1 or the image forming device 61 is, for example, a color printer, the display timing for the replacement notice of the toner cartridge 14 may be modified by taking into consideration the difference in the quantity of toner 34 used in the toner cartridges 14, namely cyan, magenta, yellow and black. To be more specific, because toner 34 contained in a toner cartridge 14 having a relatively less quantity used than other toner cartridges 14 is more susceptible to damage due to repeated stirring and friction by the developing roller 16 or the like, there is a higher probability to generate image defects such as fogging and blotting on the developed image due to an abnormality of electrical charging of toner or the like. Therefore, the timing for the replacement of the toner cartridge 14 may be moved forward in order to urge the user to replace the toner cartridge 14 at an earlier time than other toner cartridges 14.

First, in the first embodiment and the second embodiment, descriptions were given regarding the display associated with the replacement notice for the toner cartridge 14 by detecting the quantity used of toner 34 in the toner cartridge 14; however, application to other replaceable members mounted in a replaceable manner in the image forming device 1 and image forming device 61 is also possible. For instance, this is applicable to a replacement display for the process cartridge 2. To be more specific, in regards to the process cartridge 2, the display timing that relates to the replacement notice of the toner cartridge 14 may be modified based on the thickness of the paper of the recording medium 21 by counting the number of rotations of the photoconductor drum 11. When the recording medium is a thick paper having a high frequency of use by the user, film wear due to abrasion by the photoconductor drum 11 occurs faster in comparison with a case for printing standard paper. Therefore, image degradation such as a vertical line or the like on the developed image originating due to film wear of the photoconductor drum 11, can be prevented by displaying the replacement notice of the process cartridge 2 at a relatively earlier time.

Further, the present invention can be applied to the replacement display of the fixing unit 31 that is a consumable member. Regarding the fixing unit 31, the display timing of the replacement notice can be modified based on the paper thickness of the recording medium 21 by counting the number of fixed sheets of the recording medium 21 where the developed image is fixed. To be more specific, when the user frequently uses thick sheets to print, in order to ensure the ability for being fixed, the fixing temperature needs to be higher in comparison with a case for printing with standard paper. For this reason, the heat roller within the fixing unit 31 can maintain a high temperature by increasing the electric current flow that flows to the heater for heating components within the fixing unit 31. Therefore, image degradation on the developed image that originated from the deterioration of the heater and the properties of rubber of the heat roller due to frequent use under a state of high temperature can be avoided by displaying the replacement notice of the fixing unit 31 at a relatively earlier time.

Furthermore, the present invention can be applied for the replacement display of the transferring belt unit 26, which is a consumable member. Regarding the transferring belt unit 26, the display timing of the replacement notice can be modified based on the environment value 73 by counting the number of transferring sheets of the recording medium 21 to transfer. To be more specific, under a state of low temperature and humidity, the transferred electric current is adjusted so as to increase in relation to the condition of the room temperature and humidity in order to ensure excellent transferring performance. However, when the transferred electric current is high, the deterioration over time of the transfer roller 30 becomes faster in comparison with the case of printing with a standard transferred electric current. Therefore, image degradation such as fogging originated by the deterioration of the transfer roller 30 can be avoided by displaying the replacement notice of the transferring belt unit 26 at a relatively earlier time.

In addition, the present invention can be applied to the replacement display of the medium carrying roller such as the hopping roller that is a consumable member. In regards to the medium carrying roller, the display timing of the replacement notice can be modified based on the thickness of the paper of the recording medium 21 by measuring the number of carried papers of the carried recording medium 21 by the counter, not shown, or the like. To be more specific, when the paper frequently used by the user is a thick paper, the contact pressure against the carrying roller is higher than a case for printing with standard paper. Because abrasion wear of the medium carrying roller becomes larger; and therefore, by displaying the replacement notice of the medium carrying roller at a relatively earlier time, carrying failure of the recording medium 21 due to surface abrasion of the medium carrying roller can be avoided.

Further, the description provided pertained to a printing device such as the image forming device in the first embodiment and the second embodiment; however, the image forming device of the present embodiments may be provided in a copier, a facsimile machine, MFP machine, or the like. The first and second embodiments are individually exercised. Also, these embodiments are available to be exercised at the same time.

This disclosure is intended to explain how to fashion and use various embodiments in accordance with the invention rather than to limit the true, intended, and fair scope and spirit thereof. The invention is defined solely by the appended claims, as they may be amended during the pendency of this application for patent, and all equivalents thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. An image forming device, comprising:

an imaging apparatus configured to form an image according to image data and to maintain information associated with performance of the imaging apparatus;

a replaceable member that is mounted in the imaging apparatus and used for forming an image;

a consumed amount calculation unit configured to calculate a usage value of the replaceable member; and a notification control unit configured to control a replacement notification, wherein the notification control unit controls a timing of the replacement notification based on the usage value calculated by the consumed amount calculation unit and the information associated with performance of the imaging apparatus, and the notification control unit further determines the necessity of making a replacement notification by comparing the usage value and a threshold value, the threshold value being changed based on operation condition information of the imaging apparatus.

2. The image forming device according to claim 1, wherein the image forming device comprises a display unit configured to display the replacement notice in response to an instruction from the notification control unit.

3. The image forming device according to claim 1, wherein the replacement notice is a warning for a condition in which the remaining available quantity of the replaceable member is relatively low.

4. The image forming device according to claim 1, wherein the replacement notice is a warning indicating that it is time to replace the replaceable member.

5. The image forming device according to claim 1, wherein the notification control unit is configured, to control when a warning is displayed that indicates that a remaining available quantity of the replaceable member is low based on the usage value and the information associated with performance of the imaging apparatus, and to give a notice of a warning indicating that it is time to replace the replaceable member after a prescribed time period since a previous warning to replace the replaceable member.

6. The image forming device according to claim 1, wherein the notification control unit is configured, to control the timing for giving notice of a warning that the remaining available quantity of the replaceable member is low based on the usage value and the information associated with performance of the imaging apparatus, and to control the timing to give notice of a warning indicating that it is time to replace the replaceable member based on the usage value and the information associated with performance of the imaging apparatus.

7. The image forming device according to claim 1, wherein the information associated with performance of the imaging apparatus is an image area ratio calculated from a dot count value of past images, a count value of the number of printed images, and a print size of the recording medium.

8. The image forming device according to claim 7, wherein the image area ratio is a mean value of the image area ratio since the replaceable member was last replaced.

9. The image forming device according to claim 7, wherein the image area ratio is the predicted value of a current image area ratio based on a history of the image area ratio per past print job.

10. The image forming device according to claim 1, wherein the information associated with performance of the imaging apparatus is an environment value determined by ambient temperature and ambient humidity of the image forming device.

11. The image forming device according to claim 1, wherein the information associated with performance of the imaging apparatus is based on a thickness of the recording medium.

12. The image forming device according to claim 1, wherein the replaceable member is a toner cartridge.

13. The image forming device according to claim 12, wherein the consumed amount calculation unit detects a level of toner remaining in a process cartridge or a toner cartridge.

14. The image forming device according to claim 1, wherein the replaceable member is a process cartridge.

15. An image forming device, comprising:

an imaging apparatus configured to form an image according to image data and to maintain information associated with performance of the imaging apparatus;

a consumable member that is used for image forming;

a consumed amount calculation unit configured to calculate a consumption value of the consumable member; and a notification control unit configured to control a replacement notification, wherein the notification control unit controls a timing of the replacement notification based on the consumption value and the information associated with the performance of the imaging apparatus, and the notification control unit further determines the necessity of making a replacement notification by comparing the consumption value and a threshold value, the threshold value being changed based on operation condition information of the imaging apparatus.

16. The image forming device according to claim 15, wherein the consumable member is a transferring belt unit provided in the image forming device.

17. The image forming device according to claim 15, wherein the consumable member is a fixing unit provided in the image forming device.

18. The image forming device according to claim 15, wherein the consumable member is a medium carrying roller provided in the image forming device.

19. A method for controlling notification of usage expiration or near expiration of a replaceable part in an image forming device, comprising:

storing data associated with past operations of the image forming device;

calculating a consumption value of the replaceable part, which is used for forming images, wherein the consumption value relates to a remaining life of the consumable part; and controlling issuance of a warning concerning expiration of the life of the consumable part, wherein controlling the issuance of the warning includes timing the issuance of the warning based upon the consumption value and the information associated with the past operation of the imaging apparatus so as to maintain a high quality of images near the end of the life of the consumable member, and controlling the issuance of the warning further includes determining the necessity of the issuance of the warning by comparing the consumption value with a threshold, the threshold being based on operation condition information of the image forming device.

20. The method according to claim 19, wherein the consumable part is a toner cartridge and the storing of data associated with past operations of the image forming device includes storing data concerning the amount of toner used per sheet in past printing operations.

* * * * *